US005315914A

United States Patent [19]

Schumacher

[11] Patent Number: 5,315,914

[45] Date of Patent: May 31, 1994

[54] METHOD OF REDUCING THE MUZZLE NOISE OF FIREARMS AND FIREARM OF REDUCED MUZZLE NOISE

[75] Inventor: Michael Schumacher, Oberndorf, Fed. Rep. of Germany

[73] Assignee: Heckler & Koch GmbH, Oberndorf/Neckar, Fed. Rep. of Germany

[21] Appl. No.: 100,357

[22] Filed: Aug. 2, 1993

Related U.S. Application Data

[63] Continuation of Ser. No. 799,823, Nov. 26, 1991, abandoned.

[30] Foreign Application Priority Data

Dec. 7, 1990 [DE] Fed. Rep. of Germany ..... 4039141

[51] Int. Cl.[5] ..... F41A 21/06; F41A 21/28; F41A 21/32

[52] U.S. Cl. ..... 89/14.05; 89/14.3; 89/14.4

[58] Field of Search ..... 89/14.05, 14.1, 14.3, 89/14.4, 14.5

[56] References Cited

U.S. PATENT DOCUMENTS

| | | | |
|---|---|---|---|
| 559,550 | 5/1896 | Tittmann | 89/14.3 |
| 1,000,702 | 8/1911 | Thurler | 89/14.4 |
| 1,331,474 | 2/1920 | Master | 89/14.2 |
| 2,484,998 | 10/1949 | Hotchinson | 89/14.3 |
| 2,791,155 | 5/1957 | Thiel | 89/14.3 |
| 2,808,763 | 10/1957 | O'Connell | 89/14.3 |
| 3,111,882 | 11/1963 | Musser | 89/14.3 |
| 3,138,991 | 6/1964 | Malter | 89/14.05 |
| 3,177,771 | 4/1965 | McKim | 89/14.3 |
| 3,367,055 | 2/1968 | Powell | 89/14.3 |
| 3,380,344 | 4/1968 | Bucklisch et al. | 89/14.05 |
| 3,611,867 | 10/1971 | Silsby | 89/14.05 |
| 4,574,682 | 3/1986 | Hillman | 89/14.3 |
| 4,852,460 | 8/1989 | Davidson | 89/14.05 |
| 4,869,151 | 9/1989 | Chahin | 89/14.3 |
| 4,879,942 | 11/1989 | Cave | 89/14.3 |
| 4,930,396 | 6/1990 | Johnson | 89/14.3 |
| 4,942,801 | 7/1990 | Schuemann | 89/14.3 |
| 4,945,812 | 8/1990 | Mazzanti | 89/14.3 |

FOREIGN PATENT DOCUMENTS

| | | |
|---|---|---|
| 264618 | 9/1913 | Fed. Rep. of Germany . |
| 3342615 | 12/1989 | Fed. Rep. of Germany . |
| 420371 | 1/1911 | France . |
| 10365 | 4/1895 | Switzerland . |
| 203462 | 6/1939 | Switzerland . |
| 104199 | 2/1917 | United Kingdom . |

OTHER PUBLICATIONS

"Jagdballistik", W. Lampel, 2 Aufl. 1971, p. 181 Deutsches Waffen Journal Sep. 1989, pp. 1206–1207.

*Primary Examiner*—David H. Brown
*Attorney, Agent, or Firm*—Egli International

[57] ABSTRACT

A firearm with muzzle noise reducer is disclosed with one or more barrels in which the bullets reach their final velocity in front of the barrel and a muzzle noise reducer constructed such that it can divert propellant gas upon reaching the final bullet velocity. This construction for diverting the propellant generally is in form of openings located length-wise in a barrel. The openings may have different forms and arrangements, e.g. an electronic and/or inertia-activated time-control element that controls the divergence of propellent gas. A method of reducing the muzzle noise is also disclosed.

22 Claims, 4 Drawing Sheets

PRIOR ART

METHOD OF REDUCING THE MUZZLE NOISE OF FIREARMS AND FIREARM OF REDUCED MUZZLE NOISE

This is a continuation, of copending application Ser. No. 799,823 filed on Nov. 26, 1991, now abandoned.

BACKGROUND OF THE INVENTION

1. Field of Invention

The invention relates to a method for reducing the muzzle noise of fire-arms, as well as a fire-arm, in particular a shotgun.

2. Description of Related Art

In many fire-arms, the bullet, for example a small-shot charge, achieves its final velocity already before the barrel's muzzle. This allows the integration of an acceleration section and a control section within the barrel. In the acceleration section, the propelling charge accelerates the bullet to its final velocity. The control section acts as a further direction stabilizer of the bullet. Thus, no velocity increase of the bullet, at least no significant increase, occurs in the control section.

Such inner ballistic relations exist with shotguns, which are used for hunting and sport shooting, in particular.

Besides special construction characteristics, i.e. the development of a choke boring, depending on the purpose for usage, such shotguns have varying barrel lengths, that is, the control section is longer or shorter, depending on the desired dispersion of the shot.

A forest hunting shotgun or a skeet shooting shotgun is specified to develop a relatively high dispersion, while a field hunting shotgun or trap shooting shotgun must be developed, so that each shot remains as tightly together as possible. Therefore, the control sections of the shotguns are correspondingly long to their preferred purpose for usage. However, the acceleration section of the barrel is the same length for both types of guns.

Because of the often disturbing noise, it is customary, especially in skeet shooting booths, to wear ear plugs. However, since people shoot in many different directions and under considerable elevation angles, it is hardly possible to take constructive precautions against booming the environment. When skeet shooting, the noise of the shot is still audible at a relatively large distance away from the shooting booth.

It has already been suggested to provide conventional and commercial guns with a silencer. Generally, a silencer of this type is constructed from an expansion casing, which is designed before the muzzle of the barrel and essentially coaxially to it. Hereby, the propellent resulting from burning the propelling charge is caught directly after leaving the muzzle. Depending on the construction of the silencer, the expansion noise will be more or less strongly reduced.

Such silencers, however, do have disadvantages. Generally, they are best suited only for single-barrel weapons. As long as the weapons are multi shots, as is often necessary for sporting purposes, a silencer can only be used in conjunction with a magazine gun or an automatic gun. Such weapons, though, are hardly used for sporting shooting. Double, especially double over-and-under shotguns, are used more frequently than magazine or automatic shotguns. Each of the two barrels can lend its own, special dispersions by a varying choke boring at the muzzle.

Silencers, which stick out over the muzzle of the weapon, have the disadvantage that because of their damage or erroneous assembly, parts of the bullet or the small-shot charge graze the mechanism of the silencer and can, thus, be misguided, whereby one can expect the destruction or damage of the silencer.

In addition, the gun's center of gravity is located at the front as a result of the silencer being positioned before the muzzle. Thus, it allows itself to swing along with a horizontally flying goal signifying a considerable disadvantage for skeet-and trap shooting.

After all, the silencer placed on top of the barrel alters the weapon's range finder position as a result of its diameter, as far as it is even intended to carry any kind of range finder. Thus, a serious sport shooting will be strongly hampered.

From the DE-PS 31 31 265, it is known that horizontal borings are designated for diverting the propellents already in the acceleration section of the barrel, that is in the case of a hand gun. When using typical ammunition, the final velocity of the bullet can hereby be strongly reduced, for example on an area under supersonic speed. This way, the noise of a bullet is avoided. Although the fire-power will also be strongly reduced.

SUMMARY OF THE INVENTION

The invention intends to reduce the previously described disadvantages.

According to the invention, diverting the propellent only occurs after achieving the bullet's or projectile final velocity. The methods for diverting the propellent are designed and/or arranged in such a manner that they make diverting the propellent possible only within this particular time interval, which lies essentially between achieving the bullet's final velocity and the bullet's exit. The bullet's velocity, e.g. the small-shot charge, is then not decreased; the fire-power remains. Instead of a single expansion noise, at least two less intense time-spaced expansion noises are created.

Preferably, a first propellent diversion occurs when or directly after achieving the bullet's final velocity. This way, the propellent can be diverted early and rapidly. The resulting cooling of the diverted propellent via expansion also occurs early.

Preferably, the methods show one or more openings led through the barrel wall and preferably constructed length-wise in the barrel, so that the openings allow the propellent to exit only after achieving the bullet's final velocity. Such openings offer a direct diversion of the propellent. The preferred long structure of the openings makes the wearing out of a sufficiently large propellent amount possible, whereby turbulence at the edges of the openings could be limited. Also, a larger propellent amount can be diverted by such vertical slits, as this can be achieved by consecutive borings in a circular cross-section. Preferably, the openings to the barrel's middle axis are slanted or show small diverting equipment on their outside. Herewith, the warm propellent exiting from the barrel is diverted to the front.

Preferably, the opening(s) is/are arranged in the particular section of the barrel referred to as the control section in the following, in that the bullet moves at its final velocity. This way, we can almost make certain that the propellent will be diverted at the exact point in time.

Preferably, one opening is arranged in the part of the control section facing the acceleration section of the barrel, especially at the border between the acceleration and the control sections.

Preferably, the size of at least one opening must be able to be altered. This way, one can comfortably control the cross-section of the opening and, thus, the amount of the propellent exiting per time unit. This way, we can optimize the propellent diversion.

According to another version of the invention, the methods for diverting the propellent show a preferred electronic and/or an inertia activating time control element, which allows the propellent to exit the barrel within a pre-defined time interval after the propellent's ignition point in time. This time interval corresponds to the duration of the acceleration phase of the bullet. This time control element, thus, makes it possible to control the timely diverting of the propellent independently from the location of possible propellent openings, for example adjusting varying ammunition. The arrangement of the openings in the barrel of designed function sections (acceleration/control) becomes secondary. Preferably, at least one opening is arranged in the acceleration section of the barrel and shows a controllable sealing element connected with the time control element. Thereby, the propellent is removed as far away from the muzzle of the barrel as possible, that is, diverted as far back as possible. The known hindrance is therefore avoided when the propellent is exiting in the front region of the barrel, in particular in the muzzle region.

Should the fire-arm show more propellent openings, then these are preferably arranged in the entire direction of the barrel and/or in its vertical direction one after the other and preferably have a cross-section becoming smaller in the last case in the direction towards the muzzle. So, the next openings with a large lateral section are offered to the propellent to be diverted. Following, it is diverted and expanded with larger amounts. So, only a pre-expanded propellent leads to the following smaller openings (in the flow direction). This counteracts an undesired jet effect of the openings. A supersonic stream from the lateral section of the jet openings and dependent on the pressure gradient can be impaired in this manner. Simultaneously, the large openings have the advantage that possible dirt particles or corrosions on the opening edges do not cause any essential alterations of the size of the lateral section and, thus, their effectiveness.

With a fire-arm with two neighboring barrels, each of the two barrels shows at least one barrel wall opening, whereby these openings are in conjunction with each other. Herewith, propellents streaming out of the barrel just fired are directed into the other barrel. Since we are generally dealing with a large caliber gun barrel, even with this barrel, its inner space seems like a roomy expansion area. Preferably, the openings are in conjunction with each other via an activated valve depending on the barrel usage. Thus, the barrel of the function is then correspondingly controlled. An external control is then possible.

With a particularly favored version of the invention, the arrangement for reducing the muzzle noise shows at least one expansion area, in which the methods lead to diverting the propellent. The expansion area surrounds at least partially one or more barrels and stretches out over at least one part of the length of the barrel. The quantity of heat remaining in the diverted propellent is not directly expelled to the outside. The danger of burning by circumstantial touching of these openings is then averted; just as a streak formation caused by the propellent and a hindrance in conjunction with looking through the range finder. The usage of at least one additional expansion area serves to pre-expand the propellents before they are released into the environment. Especially preferred is the expansion area with the exception of the opening(s) closed on all sides. Thus, the propellent accumulated in the expansion area streams back into the barrel after the shot, since a pressure gradient from the expansion area continues to the barrel after the shot. The barrel just fired serves—just like any other barrel in conjunction with the expansion area—as a post-expansion area. All in all, the expansion of the propellent is extended in time because of that, whereby the expansion noise naturally diminishes.

As far as the opening in the barrel leads into an expansion area, its length, however, is to be limited with vertical slits. This way, transported unburned gun powder particles should not be carried through the openings, but rather remain in the control section of the barrel if possible, in order to avoid an accumulation of gun powder in the expansion area. Soiling the expansion area with gun powder would lead to a diminished effect.

According to another favored version of the invention, the expansion area stretches only to the barrel's muzzle, so that the fire-arm does not show any increase in total length.

In order to achieve a further extension of the propellent expansion, methods for decreasing the pressure and/or extending the streaming of the pressure gas are provided according to another favorite version of the invention. It is herewith possible to briefly alter the inner kinetic energy within the pressure gas into potential energy, via flexible mechanical elements. As a result of a phase shift, the streaming of the pressure gas out of the expansion area is delayed. It is also possible to alter a part of the inner energy into heat by using hyper-flexible materials. However, even check valves could be provided by the openings, in order to obstruct or slow down the return streaming of the pressure gas. All of these measures are applicable individually or in combination, as long as the soiling, heating or abrasion of the arrangement to be provided in the expansion area does not overstep a permissible measurement.

The streaming of the propellent out of the expansion area can be slowed down especially easily because the expansion area is subdivided into two chambers by at least one partition, preferably one around which the expansion area is able to stream. With most openings situated one after the other, you can avoid having a pressure wave run in the expansion area with a close distance behind the shot which hinders the streaming of the propellent through the openings. With two propellent openings, the openings preferably lead into the various chambers. With a fire-arm with many barrels, basically it is possible to design individual expansion areas for each barrel, for example since the two barrels stand in conjunction with each other via the propellent openings. By using an additional expansion area, it is indeed an advantage to provide this simultaneously for all of the barrels. Should the openings of double barrels lead into the same expansion area or into the same chamber of this expansion area, then the expansion area is enlarged by the inner area of the barrel which is not being fired when firing the other barrel. At least one expansion area arranged between the openings of double barrels standing in conjunction with each other is especially preferred. This expansion area delays the pressure balance from the barrel just fired into the barrel which was not just fired.

With an advantageous version, at least one opening is provided with an arrangement to lessen the return streaming of the pressure gas and/or an arrangement to adjust the streaming lateral section and/or an arrangement for diverting the gas. As an arrangement to lessen the return streaming, a flexible steel tongue can be provided on the outside of the openings leaning against it and fastened on only one side. This hinders and slows down the return streaming of the pressure gas from the expansion area. As an arrangement for adjusting the streaming lateral section, a cap nut can be screwed onto the outside of the barrel. Due to their axial location, vertical slits in the barrel can be covered, more or less. Herewith, the leading velocity, the noise development and the shot accuracy can be optimized depending on the cartridge just used. This is necessary, for example, with magnum cartridges where the acceleration section can be longer than with standard ammunition. With the help of the cap nut, you can easily release or seal the required group of openings.

Preferably, the expansion area shows an outer wall which conducts heat considerably worse than a steel wall. In this manner, annoyances of the shields are avoided, if this touches the heated surface of the expansion area after a long series of shots. Simultaneously, a streak formation will be avoided, which makes the goals considerably more difficult, especially when trap shooting.

One has tried to get around this disadvantage with trap guns, in that a broken "ventilated" track is placed onto the upper track and produce a considerable difference in height between the line of view and the track surface. This leads to a considerably large difference in height between the line of view and the axis of the bore of the barrel. The line of view is physiologically pinned down by the fire-arm.

Preferably, the expansion area surrounds the upper side of the barrel(s) and a viewing arrangement showing up on the track is integrated in its own upper side. By using a material that dams up the heat, a streak formation is avoided. The outer surface of the expansion area does not heat up to such a degree as the outer surface of the barrel, so that the outer surface of the expansion area can be led to the line of view. As long as the track consists of plastic or is layered with hot glue, it can be pressed onto the upper side of the wall of the expansion area. Even when using a voluminous expansion area, the fire-arm according to the invention has the same arrangement of axes of the bore of the barrel to the line of view as it is accustomed to the sport shield of typical trap guns.

Basically it is possible to lead the expansion area only until the front shaft of a gun. Preferably, the under side of the expansion area stretches into a front shaft, so that the front shaft basically surrounds the expansion area simply like a thin wall. Further preferred is replacing the front shaft of the wall of the expansion area, which is correspondingly structured. According to another favorite version, the underside of the expansion area shows an arrangement to its outer side to safely seize it, preferably a fish-skin, a groove or a corrugation. Thus, seizing the shaft becomes easier. Also, the surface of the expansion area can be glued in the region corresponding to the front shaft with leather or a non-skid track material or brought to a corresponding layer. A possible slip of the fire-arm becomes difficult in the hand.

According to a previously mentioned version, since the wall of the expansion area is structured, so that it forms a poor heat conductor, it is entirely possible to hold this wall with your hand, even if the barrels themselves have heated up considerably after a long series of shots. In any case, a shield, which detects a disturbance of the expansion area by the slight warming of the hand, avoids this disturbance by a layer or a glued material or leather, as mentioned above.

Preferably, the wall of the expansion area shows a plastic, especially a composite-material, even more so a polycarbonate. According to another version of the invention, the plastic in the wall of the expansion area is strengthened with fibers, in particular, glass- or carbon fibers. Preferably, the wall of the expansion area shows a matrix made from fibers. This fiber matrix can be coiled on a core, which can be removed either after coiling, impregnating the coil with plastic and the hardening of the plastic or built out of thin sheet metal and then it remains. Such a coiled body is, despite its slight weight, capable of withstanding the high inner pressures, which can arise through the introduced propellent in the expansion area without distortion or damage.

According to a favored version of the invention, at least the wall of the expansion area is designed to be detachable from the barrel or barrels. Thus, a cleaning and inspection can be done with simple means.

The fire-arms according to the invention could also be mortars, in particular for teargas grenades, devices to shoot signal ammunition and cords or weapons to shoot ebonite bullets or injection shots. With many barrels arranged over and/or next to another, not all barrels must show the inner ballistic relations generally required. It is even possible with an over-and-under shotgun or a three-barrel shotgun to continue building only the small-shot course or courses, according to the invention, whereby the expansion area surrounding the small-shot course or courses enforces the bullet course.

The invention of a double-barrel shotgun like those that are used for trap or skeet shooting is especially preferred. Fire-arms of this type are marked by two small-shot barrels located on top of each other or next to each other which are swivel-mounted onto a horizontal axis in a system box. The system box of the favored weapon shows, as is typical of double-barrel shotguns, a thrust base shifted to the back opposite the swivel axis of the barrel, stretching vertically and horizontal to the vertical axis of the barrel.

The two of them with their barrels fastened to each other at the thrust base end stretch out parallel to each other. Only at the front end of the system box do they show a bilateral distance.

In order to stabilize the bilateral location of the barrels, they are fastened to each other, which is typical for double-barrel shotguns. According to the invention, one of the barrels remains for the purpose of this fastening after the system box and at the muzzle, although a slightly oval end wall is brought to the barrels. The front end wall is then preferred smaller or as large as the back end wall, it could also be just as large, though.

A barrel-shaped casing is pulled over the barrels which constructs the wall of the expansion area and measures it such, that it steps with the front and back end wall in a tight contact and is held fast or sits tightly on the end walls. The barrel-shaped casing, thus, surrounds both barrels from the muzzle to the system box with distance and stretches to the upper side of the system box up to the back side of the (upper) barrel(s). The barrel-shaped casing then seals off at their thrust base end. The barrel-shaped casing is, thus, structured, so that all the uncovered parts of both barrels of a double-barrel shotgun close off at the outside. Merely the lateral area on the muzzle side of the barrel is visible with the double-barrel shotgun according to the invention when the gun lock is closed. The expansion area is, then, closed off to the outside by the front and back end wall, as well as the barrel-shaped casing, and stands over the openings in both barrels with their inner space in conjunction with each other.

Preferably, the end walls show a surrounding groove in which a gasket is placed, whereby the barrel-shaped casing stands in close contact with the gaskets.

In another favored version, both barrels show two groups of openings opposite and axially one after the other, whereby a partition is arranged between the groups subdividing the expansion area into two chambers radially stretching to the barrels and it is fastened to it.

Preferably, the barrel-shaped casing proceeds specifically in the upper region somewhat parallel to the barrel's axis, however, expands to build and provide a manual installation to its underside limited to the system box and is structured there at its outside with an order to improve the non-skidness, preferably a fish-skin.

The barrel-shaped casing is swivel-mounted together with the barrels and fastened to these, but can be removed from the front after unlocking them, in order to make it possible to clean the outside of the barrel and the inside of the barrel-shaped casing. At the upper side of the barrel-shaped casing preferably a gun bead is mounted onto the muzzle side. The upper side of the barrel-shaped casing is structured to form a corresponding track. It is also possible to press a separate track onto this upper side. The barrel-shaped casing itself is coiled from carbon fibers, which were impregnated with polycarbonate.

The resulting double-barrel shotgun weighs the same as a conventional double-barrel shotgun when you assume that the weightof the barrel-shaped casing is in accord with the one of a wooden front shaft. The center of gravity of the double-barrel shotgun according to the invention is essentially unaltered, as opposed to the center of gravity of a conventional double-barrel shotgun. The location of the line of view and of the barrels' axis of the bore, as well as the skid area of the front shaft, corresponds exactly to the corresponding measurements of a conventional double-barrel shotgun.

By correspondingly dyeing the outer surface of the barrel-shaped casing, or by setting a correspondingly formed spot at the location of the front shaft, even the front shaft can be indicated. This is how the double-barrel shotgun, according to the invention, essentially does not differ from a conventional double-barrel shotgun.

DESCRIPTION OF THE DRAWING

The subject of the invention will be further explained by reference to the figures.

The terms used in this application, such as "front", "back", "over", "under" are understood to refer to a horizontally designed weapon in the correct firing position.

"Front" is the muzzle side, "back" is the side of the back shaft; with the indicated double over-and-under shotgun, the barrel carrying the track with the range finder forms the "upper" barrel, while the barrel closest to the trigger forms the "lower" barrel.

Figure 1:
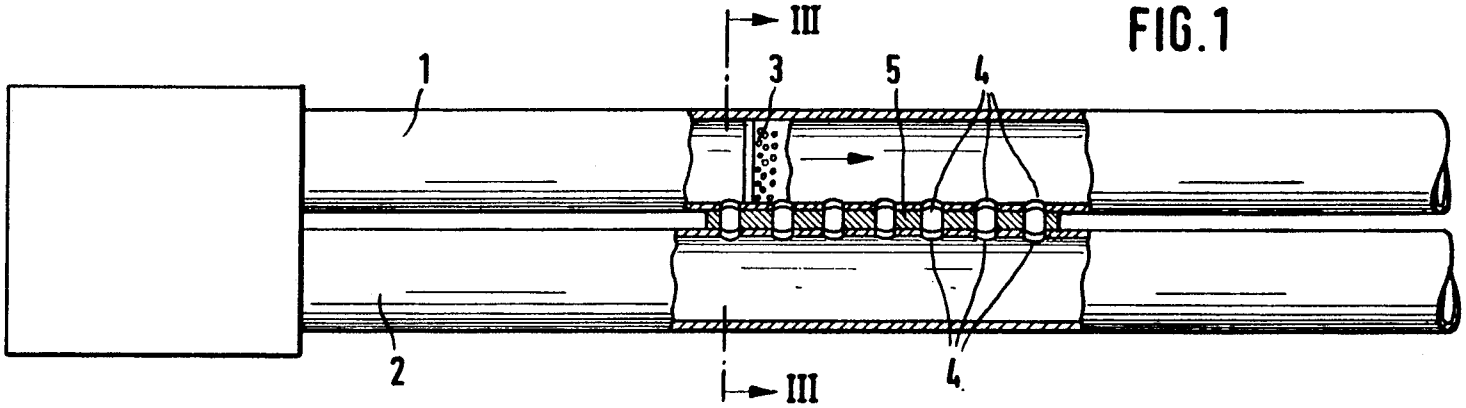
FIG. 1 shows a schematic partially cut vertical cross-section through two courses of a double over-and-under shotgun.
Figure 2:
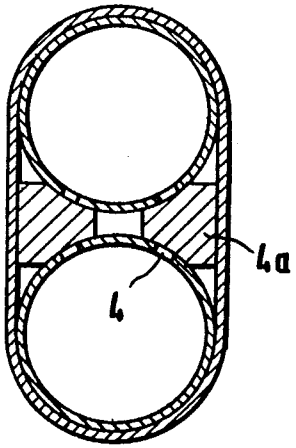
FIG. 2 the section III—III of FIG. 1 showing a surrounding casing.

In FIG. 1, the pair of barrels of a double over-and-under shotgun is schematically depicted with an upper barrel 1 and a lower barrel 2. Both barrels are tightly connected to each other, as is depicted in FIG. 2.

The upper barrel 1 is indicated shortly after the shot with a shot holder containing a shot 3 which moves in the direction of the muzzle.

Both barrels 1 and 2 are each provided with openings 4. The openings 4 of the upper barrel 1 face the openings 4 of the lower barrel 2 and are also in conjunction with them.

The openings 4 the furthest back in the longitudinal direction of the barrels 1 and 2 are arranged one after the other at a location where the gas pressure created from the burning of the propellent decreased so much so, that it has no effect on any further acceleration of the small-shot charge 3.

As perceptible, the propellent streams behind the small-shot charge 3 after adjusting to the openings 4 the furthest back through the opening 4 of the upper barrel 1 just fired into the barrel 2 not just fired. There it expands. A series of partial expansions occur one on top of the other in the lower barrel 2 corresponding to the amount of the openings 4 one after the other. Thus, the pressure in the lower barrel finally increases. The remaining pressure in the upper barrel expands to the surroundings after the small-shot charge leaves the upper barrel. The latter expansion occurs after the propellent expands through the openings 4. Further away, a shifted expansion occurs opposite the expansion at the muzzle of the barrel 1 at the muzzle of the barrel 2.

A decline in pressure to the surroundings exists during the expansion at the muzzle of the barrel 1, as well as of the barrel 2. This is lower than any which arises with a conventionally structured barrel without a side opening. Thus, a substantial decrease of the expansion noise ensues.

Figure 3C:
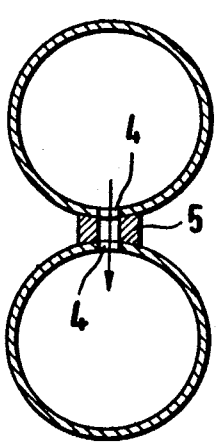
FIG. 3*a* to 3*c* show three varying versions of the sections III—III in FIG. 1.

As you can see in FIG. 1 as well as in FIG. 3*c*, a block 5 can be arranged between the two barrels 1 and 2. Concentric channels, which correspond to the borings 4, run through the block 5 in the region of the borings 4. The diameter of the channels may be as large or larger than any of the borings 4. The block 5 additionally serves to tightly bond both barrels 1, 2.

Figure 3B:
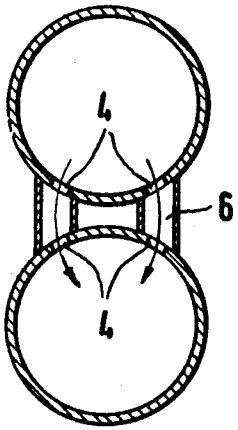
Figure 3A:
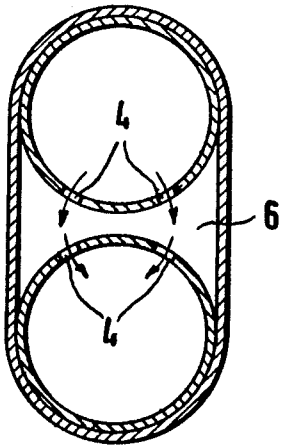

As indicated in FIG. 3*a* and 3*b*, it is still possible to design the borings 4 non-planar. Then, an individual expansion area 6 (FIG. 3*b*) will be provided between two borings opposite each other or openings 4 of both barrels for each, or a general expansion area 6 (FIG. 3*a*) for all openings 4.

In FIG. 2, a blocking bar 4*a* is arranged between the two barrels 1 and 2, so that the openings 4 can be closed with its help.

These expansion areas 6 allow a reduction in pressure over an extended amount of time and contribute to the reduction of the expansion noise. In comparison to conventional systems, this makes a shortened decrease in pressure possible.

In FIG. 3*a* to *c*, the gas streaming through the openings 4 is marked by arrows.

Figure 4:
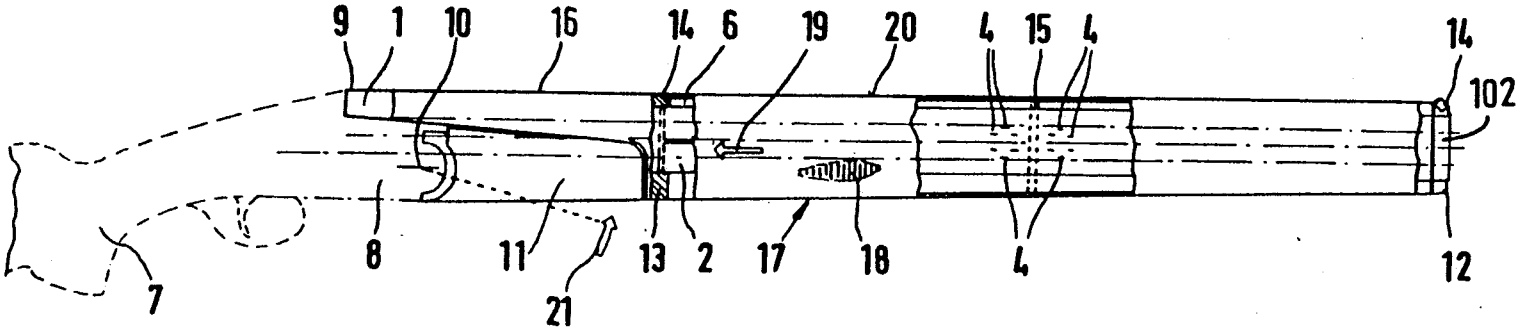
FIG. 4 shows the total side view of a double over-and-under shotgun according to the invention.

In FIG. 4, the total view of a double over-and-under shotgun is depicted with an upper barrel 1 and a lower barrel 2. Each barrel shows two groups of openings 4 one after the other. The openings 4 are arranged in the facing surface sections of the barrels and are built like long holes, which stretch in the longitudinal direction of the barrel. Though, the front group of openings prefers smaller openings 4 than the back group of openings.

The indicated double over-and-under shotgun shows a rear shaft 7 to whose front side, a system box 8 is fastened. At the back side, the system box 8 shows a vertical thrust base 9 stretching horizontally to the barrels 1, 2.

both barrels 1, 2 are swivel-mounted in the system box 8 around a swivel axis 10. One can bolt a lower cover 11 opposite the barrels 1, 2 and it limits their swivel region so much, that it does not happen without contact with the swivel axis 10. With regard to the bracket of the barrels 1 and 2, the cover 11 practices the function of the front shaft of a conventional gun.

You can lean the cover 11 against both barrels 1, 2 in the direction 21. Then it rests hard against it and you can then swivel it together with this after removing a lock not indicated here.

An end wall 12 on the muzzle side and an end wall 13 bordering the system box 8 are built on the outside of the barrels 1, 2. They radially stretch in a flange way to the two barrels 1,2, they are tightly enforced and are mounted hard onto these barrels 1, 2. If you project the contour of the fornt end wall 12 in the direction of the two barrels 1, 2 onto the rear end wall 13, then the contour of the rear wall 13 is not overlapped and it prefers not to be disturbed. Thus, the front end wall 12 is smaller than the rear end wall 13.

A surrounding groove 102 in each end wall 12, 13 accepts a gasket 14, which surpasses the outer contour of the surrounding groove. FIG. 4 illustrates the groove 102 in the endwall.

Furthermore, a partition 15 between the two groups of openings 4 is brought onto the surrounding surface of the barrels 1, 2.

Finally, a barrel-shaped casing 16 is pushed onto the two barrels 1, 2 from the front, that is in the direction of the arrow 19. In the pushed condition, this casing 16 lies with its inner surface tight against the two gaskets 14 or presses these preferably so far together, that they also lie against the surrounding surface of both end walls 12, 13. Even furthermore, the inner surface of the barrel-shaped casing 16 can lie against the partition 15.

The casing 16 shows a curvature 17 on its underside in front of the system box 8. This has the shape of a typical front shaft and is provided with a fish-skin 18 on its outer surface.

The casing 16 pushed onto the barrels 1, 2 will be locked by engaging a holding or locking device 22 opposite the barrels 1, 2.

The casing 16 extends from the back to the thrust base 9 so much so, that it forms a flush seal with the system box 8 and the cover 11 (in its closed state).

The upper side of the casing 16 is designed as a track 20.

Figure 7:
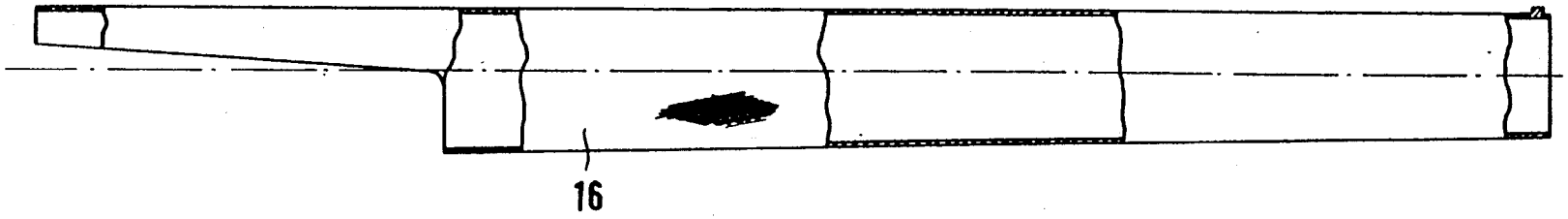
FIG. 7 shows a schematic partial vertical cross-section of the casing.
Figure 8:
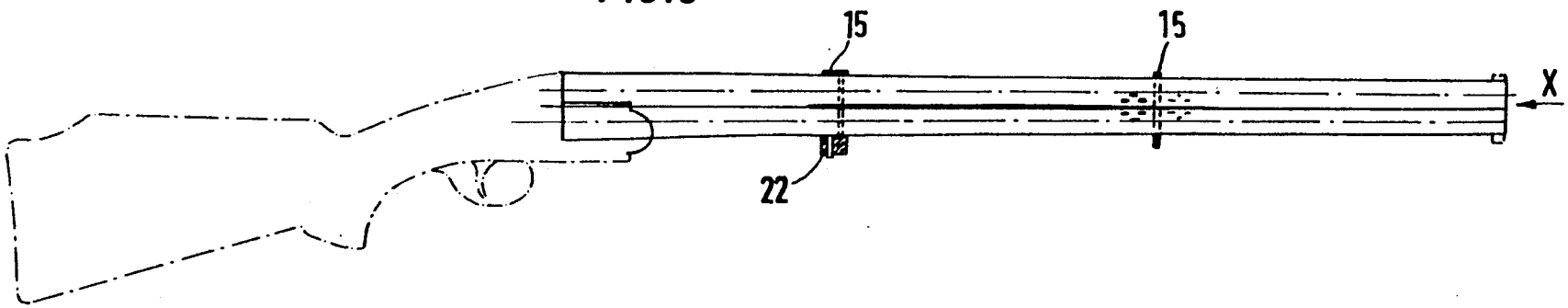
FIG. 8 shows a schematic view of a weapon with a removed casing.

The casing 16 is coiled from carbon fibers, preferably on a thin sheet metal bore; the carbon fibers are drenched with polycarbonate. The outer surface of the casing 16 is textured or glossy black, whereby the color of the region 17 of the handle can be separated. Such a casing is depicted in FIG. 7. FIG. 8 depicts a weapon with a removed casing 16. Thus, the guides 15 are arranged at the outer surrounding area of the barrels 1 and 2. Locking of the casing 16 occurs with the help of a locking device 22 arranged in the lower region of a guide 15. The locking device 22 is preferably spring-loaded.

Figure 5:
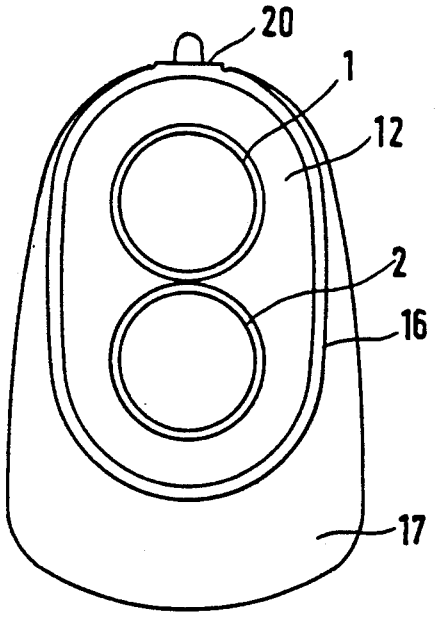
FIG. 5 shows the front view of the double over-and-under shotgun from FIG. 4.

FIG. 5 depicts a front view of the double over-and-under shotgun depicted in FIG. 4. Thereafter, the casing 16 is shaped, such that it crosses over from the front end wall 12 coming from the structure of the curved section 17 corresponding to a front shaft up to the system box 8 (not recognizable from the front).

Figure 6:
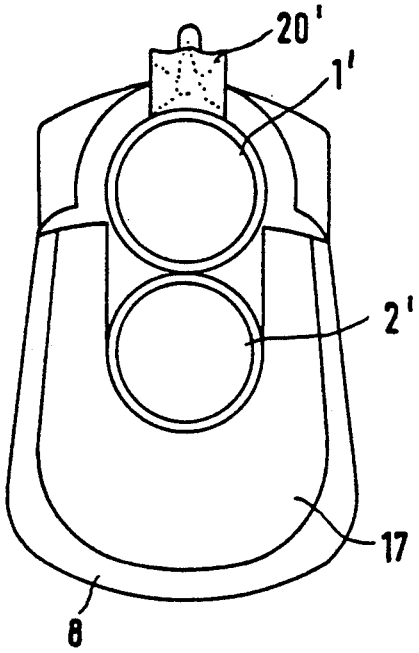
FIG. 6 shows the front view of a conventional trap double over-and-under shotgun in comparison to FIG. 5.

FIG. 6 depicts the front view of a conventional double over-and-under shotgun. A ventilated track 20' is set upon the upper barrel 1' at a relatively large distance. The large distance serves to avoid air streaks. Air streaks disturb a sighting and are a result of the heating up of the barrel 1'.

A recess 17' is brought up to the underside of the barrel 2' which bumps up against the system box 8.

As a comparison of FIGS. 5 and 6 reveals, in practice, the double over-and-under shotguns opposite each other are in accordance regarding their essential measurements (location and size of the front shaft 17, location of the axes of the barels 1, 2 and location of the track 20).

I claim:

1. A shotgun, comprising: at least one barrel in which a projectile reaches its final velocity in front of the mouth of the barrel, the barrel including an acceleration section and a subsequent control section, the control section being located where the projectile reaches its final velocity; and a muzzle noise reducer having means formed so as not to alter the muzzle velocity of said shotgun and having means for diverting propellent gas upon reaching the final projectile velocity, said means for diverting propellent gas comprises at least one opening positioned in the control section of said barrel.

2. The shotgun of claim 1, wherein said at least one opening extends though the barrel wall in such a manner that said at least one opening provides for propellent gas to emerge only upon reaching the final velocity of the projectile.

3. The shotgun of claim 1, further comprising a plurality of openings, wherein the openings lie one behind the other in the longitudinal direction of the barrel.

4. The shotgun of claim 1, wherein said at least one opening is positioned in proximity to a boundary between said control section and said acceleration section.

5. The shotgun of claim 1, comprising at least two adjacent barrels, wherein each of the two barrels has at least one opening in the barrel wall and said openings are in communication with each other.

6. The shotgun of claim 5, wherein said muzzle noise reducer comprises an expansion chamber arranged between the openings of the two barrels which are in communication with each other.

7. The shotgun of claim 1, wherein said muzzle noise reducer comprises at least one expansion chamber into which said means for diverting the propellent gas debouch and that said expansion chamber at least partially surrounds said at least one barrel and extends at least over a part of the barrel length.

8. The shotgun of claim 7, wherein said expansion chamber is closed on all sides with the exception of said at least one opening.

9. The shotgun of claim 7, wherein said expansion chamber extends only up to the barrel muzzle.

10. The shotgun of claim 7, wherein at least the wall of the expansion chamber is removable from the barrel.

11. The shotgun of claim 7, wherein said expansion chamber is divided into at least two chambers by at least one partition wall which is flowed around.

12. The shotgun of claim 11 comprising at least two propellent-gas openings, wherein the two openings debouch into different chambers.

13. The shotgun of claim 7, wherein said expansion chamber comprises an outer wall made of a material which is a poor conductor of heat.

14. The shotgun of claim 13, wherein the bottom side of the expansion chamber extends into a front shaft.

15. The shotgun of claim 14, wherein the bottom side of the expansion chamber is provided on its outer side with a surface having one of a fish skin, a grooving and a ribbing, so as to facilitate gripping.

16. The shotgun of claim 13, wherein the wall of the expansion chamber is formed by a composite material.

17. The shotgun of claim 16, wherein the composite material forming the wall of the expansion chamber is reinforced with fibers, including glass or carbon fibers.

18. The shotgun of claim 17, wherein the wall of the expansion chamber has a wound matrix of fibers.

19. A double-barrel shotgun having a system box into which the barrels are tiltably inserted and which has a set back thrust base, wherein an expansion chamber is provided with an end wall arranged fixedly on the barrels at the muzzle and directly in front of the system box, said wall of the expansion chamber is developed as a barrel-shaped covering which is pushed from the front over the barrels and is in sealing engagement with the end walls, and a covering extends on the top side of the barrels up to the thrust base and rests thereqclosely against the barrels.

20. The shotgun of claim 19, wherein each of the end walls has a circumferential groove into which a sealing ring is inserted and wherein the covering is in sealing engagement with the sealing rings.

21. The shotgun of claim 19, wherein each of the two barrels has, opposite each other, two groups of openings lying axially one behind the other, and between the two groups, there is arranged a partition which extends radially to the barrels and divides the expansion chamber into two chambers, the partition being fastened to said barrels.

22. The shotgun of claim 19, wherein the covering extends, in an upper region, approximately parallel to the barrel axis but widens, and substantially adjoins the system box, at least on its lower side, so as to form a hand rest, and is provided on its outer side with an arrangement for improving grip.

* * * * *